US007950964B1

(12) United States Patent
Little

(10) Patent No.: US 7,950,964 B1
(45) Date of Patent: May 31, 2011

(54) N-IN-1 CARD CONNECTOR UTILIZING FPC FOR IMPROVED CO-PLANARITY

(75) Inventor: Terrance F. Little, York, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/826,703

(22) Filed: Jun. 30, 2010

(51) Int. Cl.
*H01R 24/00* (2006.01)

(52) U.S. Cl. ..... 439/630; 439/67

(58) Field of Classification Search ..... 439/630, 439/67, 77
See application file for complete search history.

(56) References Cited

U.S. PATENT DOCUMENTS 6,371,770 B1 * 4/2002 Lai ..... 439/67
7,014,508 B2 * 3/2006 Tsai ..... 439/630
7,175,477 B2 * 2/2007 Tsai ..... 439/630
7,775,835 B2 * 8/2010 Ting et al. ..... 439/630
2005/0148245 A1 * 7/2005 Tsai ..... 439/630
2006/0040561 A1 * 2/2006 Chang et al. ..... 439/630
2007/0105447 A1 * 5/2007 Tsai ..... 439/630

* cited by examiner

*Primary Examiner* — Gary F. Paumen
(74) *Attorney, Agent, or Firm* — Andrew C. Cheng; Wei Te Chung; Ming Chieh Chang

(57) ABSTRACT

A card connector includes a first housing extending along a front-to-rear direction and defining a first surface and a second surface opposite to each other in a vertical direction thereof. Multiple groups of terminals are mounted on the first housing with tails projecting out of the first surface. A second housing extends along a transverse direction perpendicular to the front-to-rear direction and is fixed on the first housing. A group of converting terminals are mounted on the second housing with solder tails projecting out of the second surface and connecting portions projecting out of the first surface. A flexible printed circuit defines an input end and an output end thereof. The flexible printed circuit is attached to the first surface of the first housing with the tails of the multiple groups of terminals connecting with the input end and connecting portions of the converting terminals connecting with the output end.

15 Claims, 6 Drawing Sheets

N-IN-1 CARD CONNECTOR UTILIZING FPC FOR IMPROVED CO-PLANARITY

BACKGROUND OF THE INVENTION

1. Field of the Invention

The present invention relates to a N-IN-1 card connector, and more particularly to a N-IN-1 card connector utilizing a flexible printed circuit for improving the co-planarity of the tails of the multiple groups of terminals.

2. Description of the Related Art

A card connector apparatus is generally used as an expanded recording apparatus of an electronic equipment such as a personal computer or a digital camera. As a storage medium of the card connector apparatus, a PC card or a memory card has come into wide use. This PC card or memory card is installed in the card connector apparatus to write and read necessary information. In recent years, as small memory cards, such as a long one, a short one, a thick one, or a thin one, have been developed, and various kinds of card connector apparatuses adapted for receiving multiple kinds of cards have been developed. In this kind of card connector, multiple groups of contacts are provided for electrically contact with the corresponding memory cards, meanwhile, multiple tails of the contacts project outwardly for mounting onto a printed circuit board, which bring a difficulty for controlling the co-planarity of the tails. Obviously, an improved card connector is highly desired to overcome the aforementioned problem.

SUMMARY OF THE INVENTION

Accordingly, an object of the present invention is to provide a card connector for improved co-planarity of the tails.

In order to achieve the object set forth, a card connector includes a first housing extending along a front-to-rear direction and defining a first surface and a second surface opposite to each other in a vertical direction thereof. Multiple groups of terminals are mounted on the first housing with tails projecting out of the first surface. A second housing extends along a transverse direction perpendicular to the front-to-rear direction and is fixed on the first housing. A group of converting terminals are mounted on the second housing with solder tails projecting out of the second surface and connecting portions projecting out of the first surface. A flexible printed circuit defines an input end and an output end thereof. The flexible printed circuit is attached to the first surface of the first housing with the tails of the multiple groups of terminals connecting with the input end and connecting portions of the converting terminals connecting with the output end.

Other objects, advantages and novel features of the invention will become more apparent from the following detailed description of the present embodiment when taken in conjunction with the accompanying drawings.

DETAILED DESCRIPTION OF THE INVENTION

Figure 1:
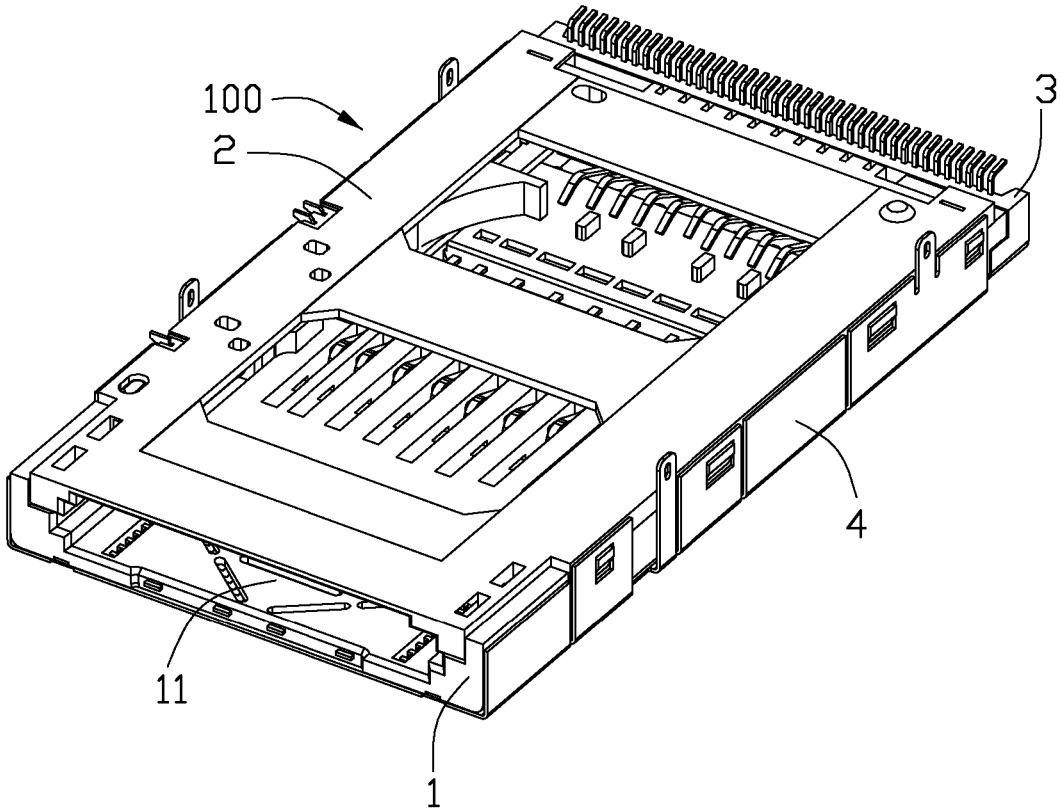
FIG. 1 is a perspective view of a card connector in accordance with the present invention, seen from a bottom side.
Figure 2:
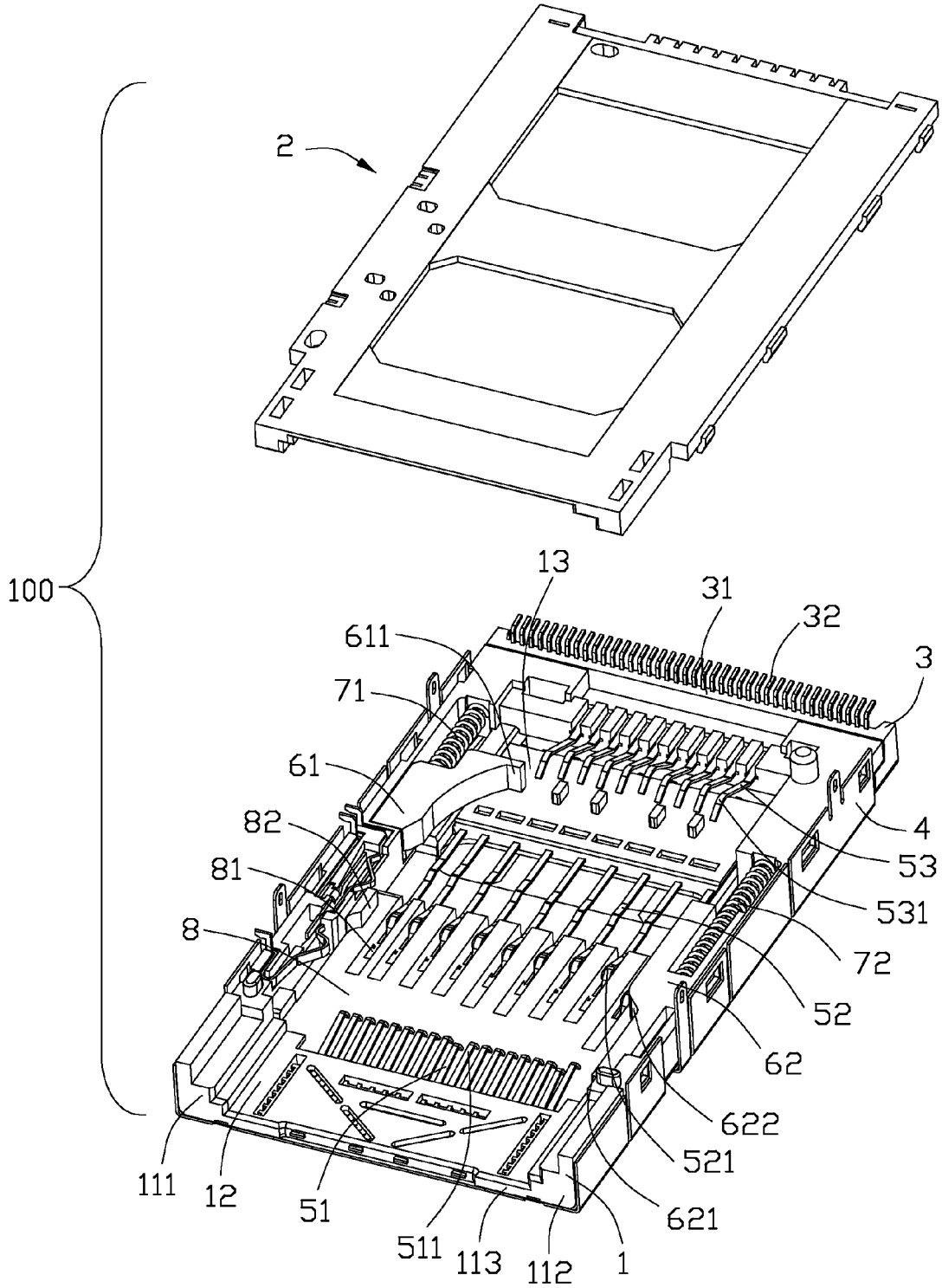
FIG. 2 is an exploded perspective view of the card connector shown in FIG. 1, which shows a detailed configuration inside the card connector.
Figure 5:
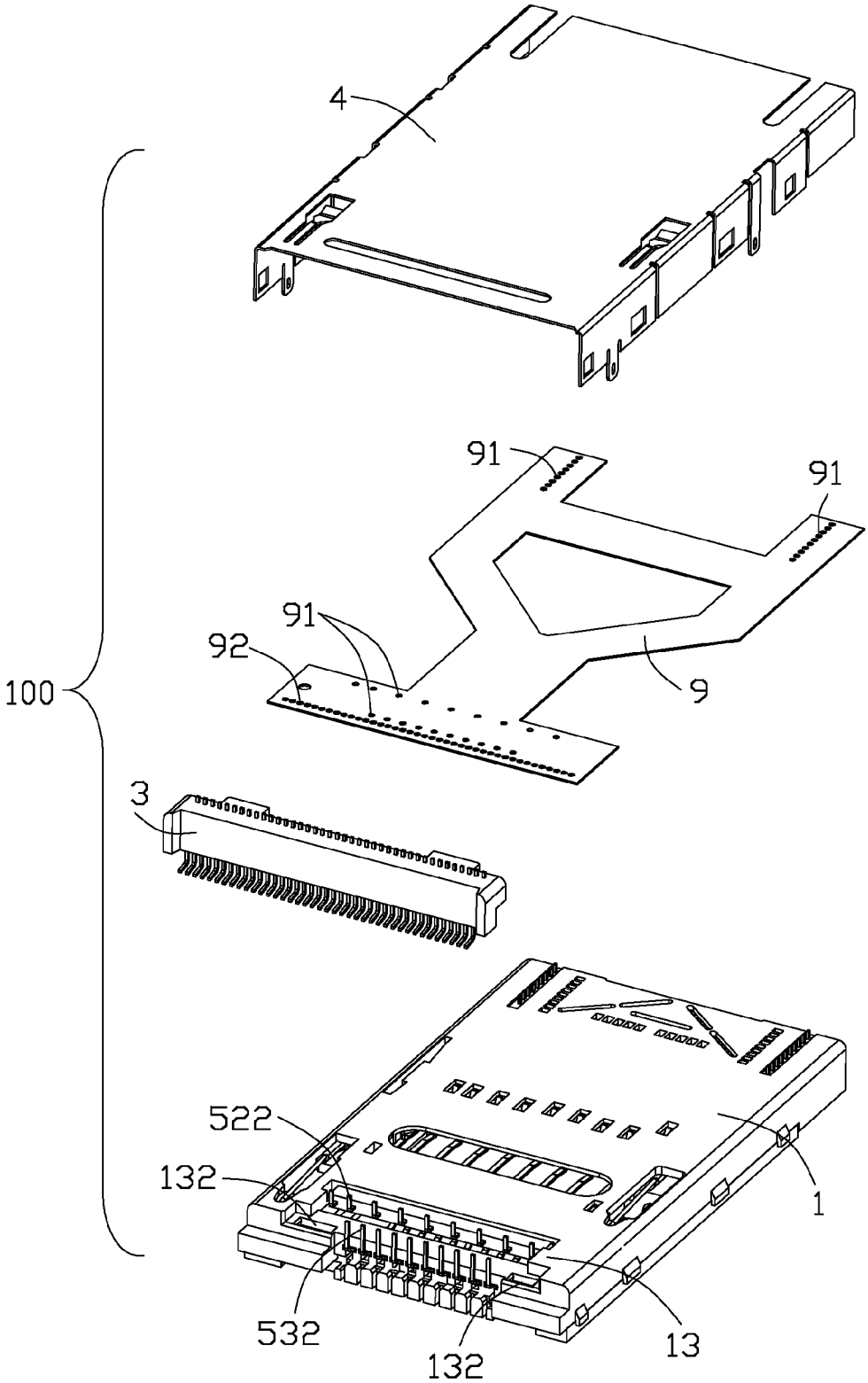
FIG. 5 is another exploded perspective view of the card connector shown in FIG. 3.
Figure 6:
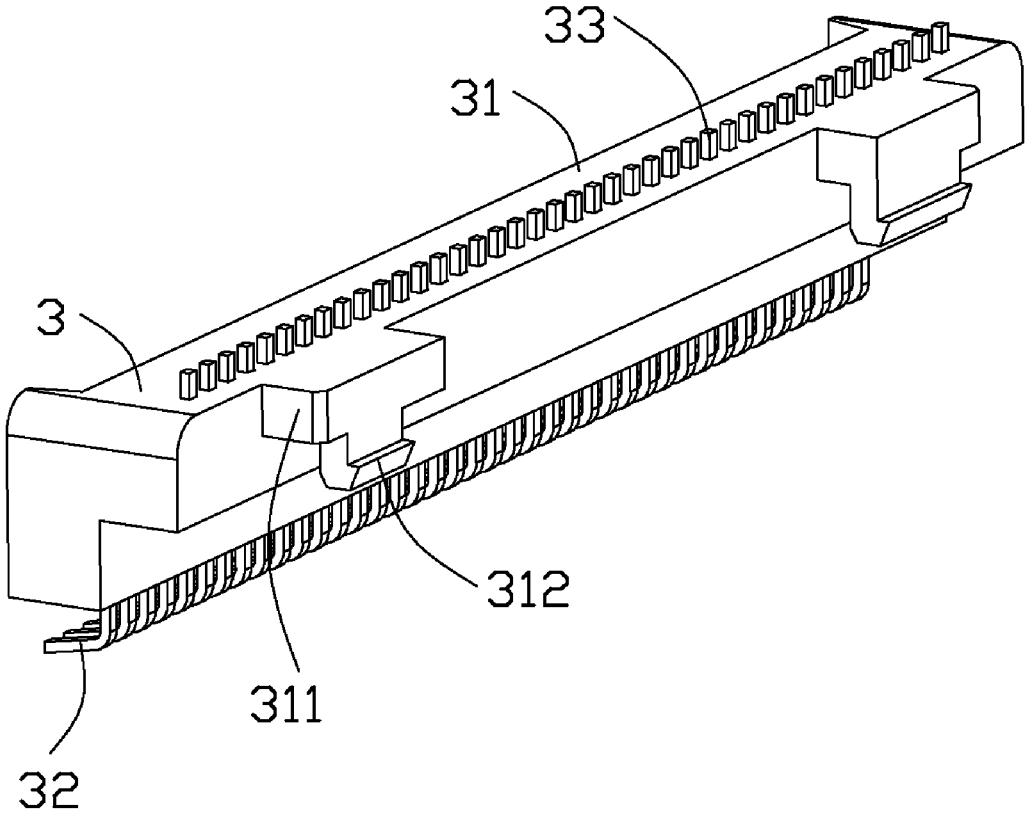
FIG. 6 is a perspective view of a footer of the card connector shown in FIG. 3.

Reference will now be made to the drawing figures to describe a preferred embodiment of the present invention in detail. Referring to FIGS. 1, 2 and 5, a card connector 100 made according to the preferred embodiment of the present invention is provided and comprises a main housing 1, an insulative cover 2, a plurality of conductive terminals, a metallic shell 4, a pair of ejecting device, a moveable plate 8, a footer 3 and a flexible printed circuit (FPC) 9.

Figure 3:
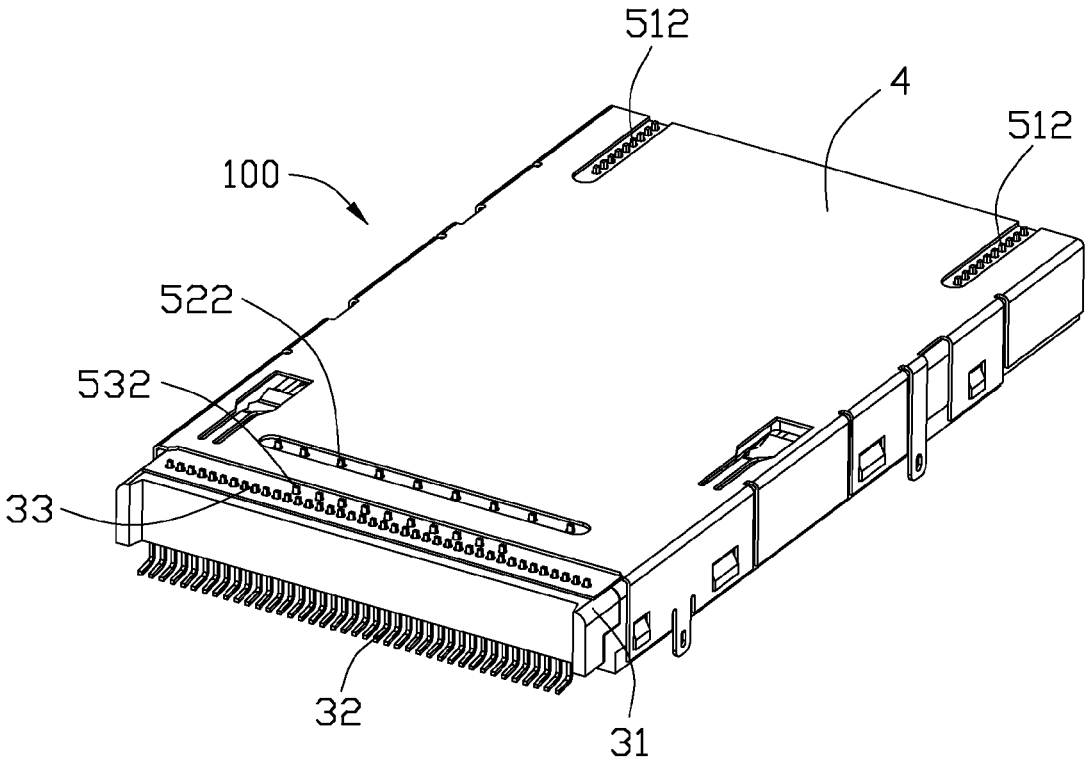
FIG. 3 is another perspective view of the card connector shown in FIG. 1, seen from a top side.

Referring to FIGS. 2 and 3, the main housing 1 is configured as a rectangular shape and comprises a bottom wall 113, a first side wall 111 and a second side wall 112 located at opposite sides of the bottom wall 113 thereby defining a receiving cavity 11 opened upwardly and extending along a front-to-rear direction. The bottom wall 113 comprises a front section 12 and a rear section 13 at opposite longitudinal ends thereof. A plurality of first terminals 51 made of conductive metal material are arranged side by side at the front section 12, and each comprises a first tail 512 projecting out of the bottom wall 113 and a first contacting portion 511 extending rearwardly and exposed into the receiving cavity 11 for electrically contacting with a first card. The first tails 512 of the first terminals 51 are arranged into two rows and respectively located at opposite sides of the front section 12 along the front-to-rear direction. A plurality of third terminals 53 made of conductive metal material are arranged side by side at the rear section 13, and each comprises a third tail 532 projecting out of the bottom wall 113 and a third contacting portion 531 extending forwardly and projecting into the receiving cavity 11 for electrically contacting with a third card.

A plurality of second terminals 52 made of conductive metal material are arranged side by side at the rear section 13 and located in front of the third terminals 53, and each comprises a second tail 522 projecting out of the bottom wall 113 and a second contacting portion 521 extending forwardly and projecting into the receiving cavity 11 for electrically contacting with a second card. That is to say, the second contacting portions 521 and the first contacting portions 511 are face-to-face arranged. A moveable plate 8 is provided between the front section 12 and the rear section 13 and defines a plurality of guiding slots 81 thereon for respectively receiving the second contacting portions 521. A blocker 82 is formed at one side of the moveable plate 8 and is pushed by a front end of the second card when the second card is inserted into the receiving cavity 11 and moves rearward together with the guiding slot, so that the guiding slots 81 will urge the second contacting portions 521 to move upward and contact with conductive pads formed on the second card.

A first ejecting device, which comprises a first slider 61 and a first spring 71 interconnected with the first slider 61 and the first side wall 111, is provided at the first side wall 111 and located adjacent to the rear section 13. The first slider 61 is configured as an L-shaped configuration and defines a blocking face 611 projecting outwardly and facing forwardly for abutting against the third card when the third card is inserted into the receiving cavity 11. A second ejecting device, which comprises a second slider 62 and a second spring 72 interconnected with the second slider 62 and the second side wall 112, is provided at the second side wall 112 and located adjacent to the front section 12. The second slider 62 is lying along the front-to-rear direction and respectively forms a first blocking face 621 and a second blocking face 622 in an offset manner for respectively abutting against the first card and the second card when said card is inserted into the receiving cavity 11. The insulative cover 2 is assembled on the main housing 1 for enclosing the first and second ejecting devices therein.

Figure 4:
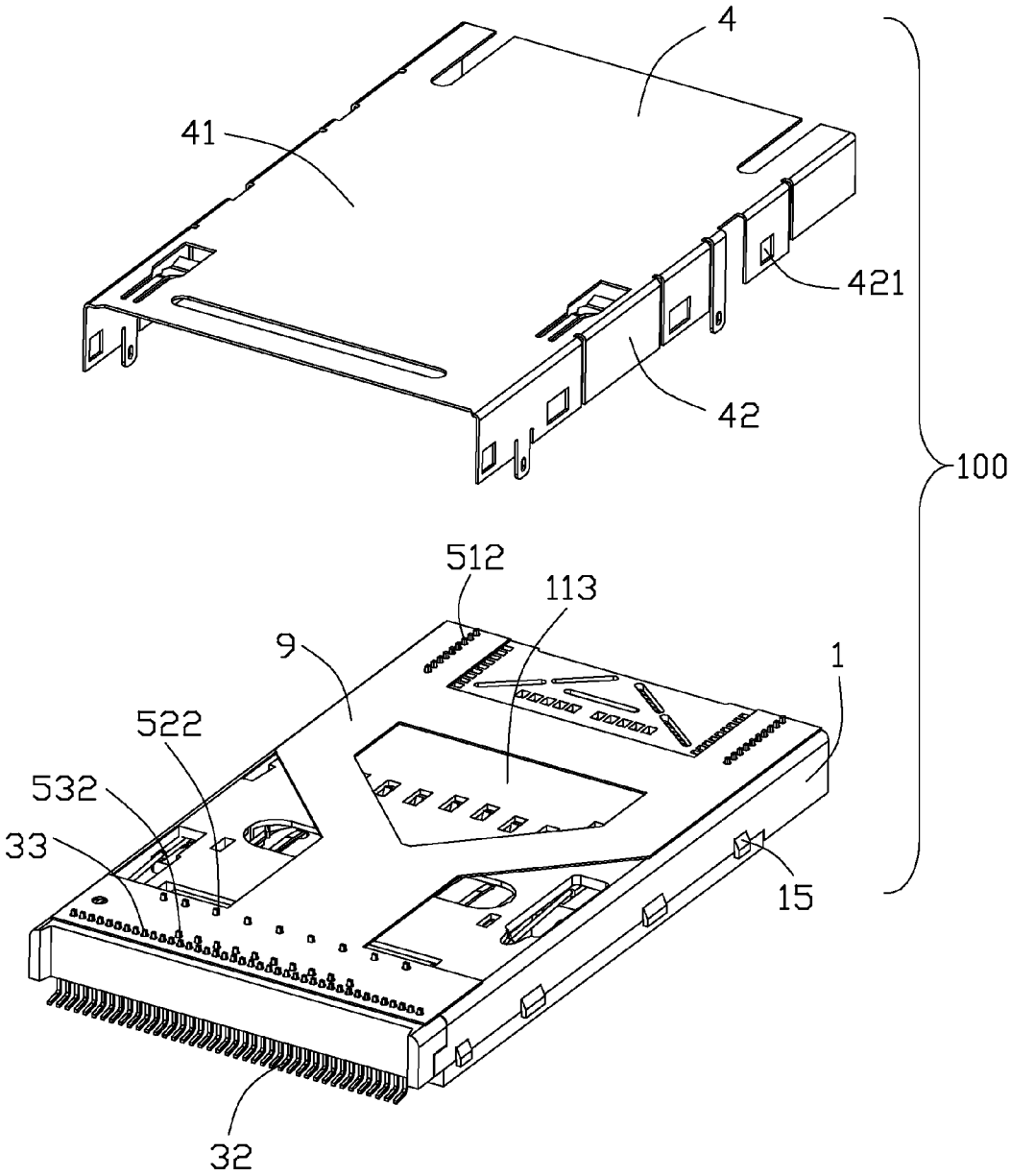
FIG. 4 is an exploded perspective view of the card connector shown in FIG. 3.

Referring to FIGS. 3-5, the second and third tails 522, 532 are respectively arranged in a row on the bottom wall 113 adjacent to the rear section 13, which are spaced from each other and extend along a transverse direction perpendicular to the front-to-rear direction. The first tails 512 are arranged at the other end of the bottom wall 113, therefore it is not easy for aligning the first tails 512, the second and third tails 522, 532 in a co-planarity manner. The flexible printed circuit 9 defines a plurality of mounting holes 91 thereon for respectively receiving the first, second and third tails 512, 522, 532 therein so as to form an input end. The flexible printed circuit 9 also defines a plurality of mounting holes 92 arranged in a row and located at a distal end thereof so as to form an output end. The input end and the out put end are electrically connected with each other by conductive circuits formed on the flexible printed circuit 9. The flexible printed circuit 9 is attached to the bottom wall 113 of the main housing 1 with the first, second and third tails 512, 522, 532 respectively received in the mounting holes 91. As the flexible printed circuit 9 has a preferable flexibility, the first, second and third tails 512, 522, 532 are easily to be electrically connected with the corresponding mounting holes 91, which will reduce the requirement for the co-planarity of the tails.

Furthermore, a footer 3, which comprises a plurality of converting terminals insert-modeled in an elongated insulative body 31, is provided to electrically contact with the output end of the flexible printed circuit 9. Each converting terminal comprises a connecting portion 33 and a solder tail 32 extending perpendicular from the connecting portion 33. The solder tails 32 are configured as surface mounting types. Additionally, a pair of locking portions 311 are respectively protruding outward from one side of the insulative body 31, at a distal end of which a hook 312 is formed and protruding downwardly. The footer 3 is assembled onto the rear section 13 from the bottom side of the bottom wall 113, with the hooks 312 respectively received in apertures 132 defined at opposite sides of the third tails 532. The connecting portions 33 are located at a same side with the second and third tails 522, 532 and respectively received in the corresponding mounting holes 92 on the output end of the flexible printed circuit 9.

After the flexible printed circuit 9 is attached to the bottom wall 113, the metallic shell 4 is assembled on the main housing 1. The metallic shell 4 comprises a main plate 41 and a pair of side plates 42 perpendicularly extending from the main plate 41. The side plates 42 define a plurality of openings 421 thereon for respectively receiving and locking with protrusions 15 formed on the first and second side walls 111, 112.

The present invention utilizes the footer 3 and the flexible printed circuit 9 to electrically connect with the tails of the conductive terminals. As the solder tails 32 are arranged in a tidy and order row to be soldered onto corresponding traces on a printed circuit board on which the card connector 100 is mounted, which can reduce the co-planarity requirement during the soldering process of the card connector. Moreover, the footer 3 is fixed in the main housing 1 by a locked manner, which makes the card connector 100 compact and good looking.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector which is soldered onto a printed circuit board and adapted for receiving multiple kinds of cards therein comprising:

a main housing having a bottom wall and a pair of side walls at opposite sides of the bottom wall so as to define a receiving cavity therebetween and extending along a front-to-rear direction;

multiple groups of terminals, each comprising a contacting portion projecting into the receiving cavity and a tail extending out of the bottom wall, said tails being arranged into separated rows;

a flexible printed circuit defining an input end for connecting with said tails and an output end thereof; and an individual footer locked with the main housing, comprising solder tails adapted for soldering onto corresponding traces defined on the printed circuit board and connecting portions connected with said output end of the flexible printed circuit.

2. The card connector as described in claim 1, wherein the footer comprises an insulative body with a plurality of converting terminals insert-molded therein.

3. The card connector as described in claim 2, wherein the insulative body comprises a pair of locking devices projecting downwardly from said insulative body, said locking devices being received and locked with apertures defined on the main housing.

4. The card connector as described in claim 3, wherein the footer is assembled onto the main housing from the bottom wall and located adjacent to a rear end of the main housing, and the solder tails and the connecting portions are located at opposite sides of the bottom wall in a vertical direction.

5. The card connector as described in claim 1, wherein a cover is provided to be assembled onto the main housing to enclose the flexible printed circuit and the main housing therein, and the solder tails are located adjacent to but do not contact with the cover.

6. The card connector as described in claim 5, wherein a first and a second ejecting devices are respectively defined at opposite sides of the receiving cavity, the first ejecting device defining a first and a second ejecting faces for abutting against a first and a second cards, the second ejecting device defining a third ejecting face adjacent to the footer for abutting against a third card.

7. A card connector which is soldered onto a printed circuit board and adapted for receiving multiple kinds of cards therein comprising:

a first housing extending along a front-to-rear direction and defining a first surface and a second surface opposite to each other in a vertical direction thereof, multiple groups of terminals mounted on the first housing with tails projecting out of the first surface;

a second housing extending along a transverse direction perpendicular to the front-to-rear direction and fixed on the first housing, a group of converting terminals mounted on the second housing with solder tails projecting out of the second surface and connecting portions projecting out of the first surface; and a flexible printed circuit defining an input end and an output end thereof;

wherein the flexible printed circuit is attached to the first surface of the first housing with the tails of the multiple groups of terminals connecting with the input end and connecting portions of the converting terminals connecting with the output end.

8. The card connector as described in claim 7, wherein the second housing is assembled onto the first housing along the vertical direction and forms a pair of hooks extending downwardly to be received in apertures defined on the first housing.

9. The card connector as described in claim 8, wherein a third housing with no terminals therein is provided and attached to the second surface of the first housing.

10. A card connector comprising:

an insulative housing defining a card receiving cavity and having a plurality of first contacts integrally molded within a front portion thereof;

a terminal module including an insulator attached upon the housing and having a plurality of second contacts integrally molded within a front area thereof, and further having a plurality of third contacts assembled to a rear area thereof, all first, second and third contacts defining corresponding contacting sections extending toward the receiving cavity, and further defining corresponding connecting sections extending in at least a vertical direction away from the receiving cavity to connect to a daughter printed circuit board;

a moveable plate back and forth movable within the receiving cavity to have the contacting sections of the second contacts up and down moved within the receiving cavity in said vertical direction; and a footer assembled around a rear end of the housing and enclosing a plurality of fourth contacts electrically and mechanically connected between a mother printed circuit board and said daughter printed circuit board.

11. The card connector as claimed in claim 10, wherein said daughter printed circuit board is flexible.

12. The card connector as claimed in claim 11, further including a metallic shell cooperating with the housing to sandwich said daughter printed circuit board therebetween in said vertical direction.

13. The card connector as claimed in claim 10, wherein said daughter printed circuit board defines a Y-shaped area and leaves some areas of the housing uncovered.

14. The card connector as claimed in clam 13, further including a pair of ejection devices each having a guiding pin moveable along a heart-shaped groove to determine a position of a slider which is interacted with an inserted card, wherein said guiding pin is located at said uncovered areas and pressed by a spring arm unitarily extending from the shell.

15. The card connector as claimed in claim 10, wherein the connecting sections of the first contacts are arranged in a first direction while those of the second contacts are arranged in a second direction perpendicular to said first direction.

* * * * *